US010589157B2

(12) United States Patent
Kinner

(10) Patent No.: US 10,589,157 B2
(45) Date of Patent: Mar. 17, 2020

(54) FLYING OBJECT GAME

(71) Applicant: OMNIGAMES, INC., Colorado Springs, CO (US)

(72) Inventor: Michael Kinner, Colorado Springs, CO (US)

(73) Assignee: Omnigames, Inc., Colorado Springs, CO (US)

( * ) Notice: Subject to any disclaimer, the term of this patent is extended or adjusted under 35 U.S.C. 154(b) by 0 days.

(21) Appl. No.: 16/189,222

(22) Filed: Nov. 13, 2018

(65) Prior Publication Data

US 2019/0091534 A1 Mar. 28, 2019

Related U.S. Application Data

(63) Continuation-in-part of application No. 15/974,378, filed on May 8, 2018.

(60) Provisional application No. 62/507,522, filed on May 17, 2017.

(51) Int. Cl.

| | |
|---|---|
| ***A63B 67/06*** | (2006.01) |
| ***A63G 31/00*** | (2006.01) |
| ***A63H 33/18*** | (2006.01) |
| ***F41J 1/10*** | (2006.01) |
| ***F41J 5/24*** | (2006.01) |

(Continued)

(52) U.S. Cl.

CPC ..... *A63B 67/06* (2013.01); *A63G 31/007* (2013.01); *A63H 33/18* (2013.01); *F41J 1/10* (2013.01); *F41J 5/22* (2013.01); *F41J 5/24* (2013.01); *F41J 7/04* (2013.01); *A63F 2250/0407* (2013.01)

(58) Field of Classification Search

CPC ... A63B 67/06; A63B 67/00; F41J 5/18; F41J 5/24; F41J 5/22; F41J 1/10; A63G 33/00; A63G 31/007; A63H 33/18; A63F 2250/0407

See application file for complete search history.

(56) References Cited

U.S. PATENT DOCUMENTS 3,843,127 A 10/1974 Lack
3,866,916 A * 2/1975 Clarke ..... A63F 9/0243 273/338

(Continued)

FOREIGN PATENT DOCUMENTS

EP 2848290 A1 3/2015
KR 20100048575 A 5/2010

OTHER PUBLICATIONS

International Application No. PCT/US2018/060729; International Search Report and the Written Opinion of the International Searching Authority; Applicant Omnigames, Inc.; dated Jan. 16, 2019.

(Continued)

*Primary Examiner* — Jeffrey S Vanderveen
(74) *Attorney, Agent, or Firm* — Martensen IP

(57) ABSTRACT

A flying object water game by which an object is thrown or tossed at a framework on which water emitting targets reside. A target framework includes one or more detachable water emitting targets. A first team defends the framework while a second team throws or tosses, from a predetermined distance, a flying object at the target framework and associated water emitting targets with the objective to hit and detach one or more targets from the framework.

15 Claims, 9 Drawing Sheets

(51) Int. Cl.
*F41J 5/22* (2006.01)
*F41J 7/04* (2006.01)

(56) References Cited

U.S. PATENT DOCUMENTS

| | | | | | |
|---|---|---|---|---|---|
| 4,243,220 | A * | 1/1981 | Shelley | A63F 9/0079 | 273/458 |
| 4,909,518 | A | 3/1990 | Erlandson et al. | | |
| 5,382,028 | A * | 1/1995 | Sciandra | A63B 67/06 | 273/401 |
| 5,540,610 | A * | 7/1996 | Sneddon | A63H 33/18 | 446/236 |
| 5,586,767 | A * | 12/1996 | Bohland | A63B 67/00 | 273/349 |
| 5,779,240 | A * | 7/1998 | Santella | F41B 9/0053 | 273/349 |
| 5,848,793 | A | 12/1998 | Celis | | |
| 6,149,488 | A | 11/2000 | Stark | | |
| 6,241,251 | B1 * | 6/2001 | Trifonov | A63B 67/06 | 273/339 |
| 6,296,252 | B1 | 10/2001 | Hubka | | |
| 8,037,906 | B1 | 10/2011 | Grillo | | |
| 8,287,406 | B2 | 10/2012 | Biederman et al. | | |
| 9,108,094 | B2 * | 8/2015 | Cello | A63B 63/00 | |
| 9,702,667 | B1 * | 7/2017 | Gutierrez | F41J 9/02 | |
| 2008/0121309 | A1 | 5/2008 | Boise et al. | | |

OTHER PUBLICATIONS

International Application No. PCT/US2018/032986; International Search Report and Written Opinion of the International Searching Authority; Applicant Omnigames, Inc.; dated Sep. 3, 2018.

* cited by examiner

FLYING OBJECT GAME

RELATED APPLICATION

The present application is a continuation-in-part and claims the benefit of priority to U.S. patent application Ser. No. 15/974378 filed 8 May 2018 which in turn claims priority to U.S. Provisional Patent Application No. 62/507,522 filed 17 May 2017, both of which are hereby incorporated by reference in their entirety for all purposes as if fully set forth herein.

BACKGROUND OF THE INVENTION

Field of the Invention

Embodiments of the present invention relate, in general, to an outdoor game and more particularly to an outdoor game having a plurality of targets.

Relevant Background

As seasons change and temperature rises outdoor activities become more and more prevalent. Children and adults alike enjoy outdoor games that are enjoyable and involve water to keep them cool and comfortable. Swimming pools, sprinklers and garden hoses are all means by which friends and families enjoy the summer months with aid of water and splashing.

Games that combine water and competition have long been a summer favorite. For the simple prices of a bag of balloons and a water source, an entire family can exercise their competitive will and demonstrate their throwing skills as a rewarding splash on an unsuspecting target signals a successful attack. Moreover, games with flying discs and objects thrown at targets offer the ability to develop and maintain fitness, agility, eye hand coordination, team building and camaraderie.

Outdoor games that combine a competitive objective, a degree of skill, camaraderie and water that provide relief to hot weather remain in demand. A need therefore exists for a game and its associated methodology for a flying object game by which competitively participating in the game may result in getting wet and wherein winning involves a certain degree of skill.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

A flying object game by which an object is thrown or tossed at a framework on which targets reside is hereafter described by way of example. The flying object game of the present invention includes at least one target framework on which detachably resides one or more targets. A first team defends the framework while a second team throws or tosses, from a predetermined distance, a flying object at the target framework and associated targets with the objective to hit and detach one or more targets from the framework.

Posed behind the target framework, the first team stands ready to either catch any detached targets before they strike the ground or catch the flying object in the event the flying object misses its mark. Points are assessed to the first team for any target they are able to detach from the target framework. And the second team gains points for catching the flying object in those instances in which the flying object misses its intended target, or when the second team is able to rescue a detached target before it strikes the ground. Multiple variations of the game described above are described hereafter along with descriptions of the flying objects, target framework and targets.

In one embodiment of the present invention a kit for a water emitting outdoor game includes at least one target framework, at least one water emitting target adapted to detachably interlock with the at least one target framework, and at least one object configured to be thrown by a person for detaching the at least one water emitting target from the target framework. In addition, each water emitting target includes a releasable water vessel or reservoir that upon an impact from the flying object or striking the ground releases the enclosed water.

Additional features of the kit for a water emitting outdoor game include that the target framework is adapted to couple to a water source and the target framework is adapted to emit water responsive to being impacted by the object. The target framework of the invention is, in one embodiment, adapted to include a base, a vertical support structure connected to the base and adapted to couple with the water source, and a horizontal structure coupled to the vertical structure apart from the base and adapted to interlock with the water emitting targets and wherein the vertical structure and horizontal structure are adapted to transport water from the water source to the at least one water emitting targets.

Another feature of the kit of the present invention is that the target framework is adapted to supply water to the water vessel of the at least one water emitting target when the at least one water emitting target is interlocked with the target framework. In addition, the target framework is configured to couple with an additional target framework to create even a larger target structure so that the game can involve larger groups of individuals rather than small teams.

In one embodiment of the present invention the object being tossed or thrown toward the target frameworks is a flying disk while in another embodiment of the present invention the object being thrown is one of the detachable targets, albeit already detached from the target framework. In yet other embodiments the flying objects can be soft/foam projectiles such as darts, bullets, or arrows.

Another embodiment of the present invention is a water emitting game apparatus coupled to a water source intended for use by at least two teams. In such an embodiment the target framework includes a base, a vertical support structure connected to the base that is adapted to couple with the water source, and a horizontal structure coupled to the vertical structure apart from the base.

The apparatus includes at least one water emitting target that is adapted to detachably interlock with the target framework. The water emitting target further includes a releasable water vessel that, upon impact from a flying object and detaching from the target framework, releases water from the release water vessel. A valve coupled to the target framework is adapted to supply water from the water source to the releasable water vessel within the water emitting target when interlocked with the target framework so that the targets can be recharged with water and, when detached, release a water spray for a predetermined period of time hitting any nearby players.

One feature of the present invention is that at least one water emitting target includes a male fitting and wherein the target framework includes a female fitting adapted to couple with the male fitting to interlock the at least one emitting target to the target framework. The fitting is further adapted to detach the at least one water emitting target in a predetermined direction upon impact from the flying object. Other means by which to detachably couple a water emitting target to the target framework are magnets, hook and loop combinations, compression fittings, and the like.

In yet another embodiment of the present invention, a method for playing a game by a first team and a second team having a water emitting game apparatus coupled to a water source begins by positioning the first team and the second team in a facing relation to one another and separated by a predetermined distance. A target framework is placed proximate with the first team and at least one water emitting target is detachably interlocked with the target framework. The game begins by tossing a flying object by the second team towards the target framework and the at least one water emitting target. The second team scores responsive to dislodging at least one water emitting target from the target framework by the flying object. And, the first team scores responsive to catching the dislodged water emitting target and/or the flying object.

In one version of the game the score for catching the "detached" object is larger than the score gained by hitting and detaching the object. Thus, the team on the defense is motivated to remain close to the target framework.

Another embodiment of the present invention utilizes the targets, target framework and flying objects but removes the water as an integral aspect of the game. Targets again are suspended from a framework as players attempt to dislodge them from their resting place. In one instance a circular area is inscribed around a central framework. Players from one team stand behind the boundary and toss flying objects at a centrally located framework on which detachable targets reside, in an attempt to detach the targets. Concurrently a defending team stands within and surrounding the framework. As the flying objects are directed toward the targets the defending team may intercept or block them from reaching their intended goal. The offensive teams have a 360-degree field of play but must remain outside of the boundary and within the field of play.

Another aspect of the present invention in to enable the game, with or without water, to be played at night. The flying objects and/or targets can include or infused with a material that emits light or glows in the dark.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1:
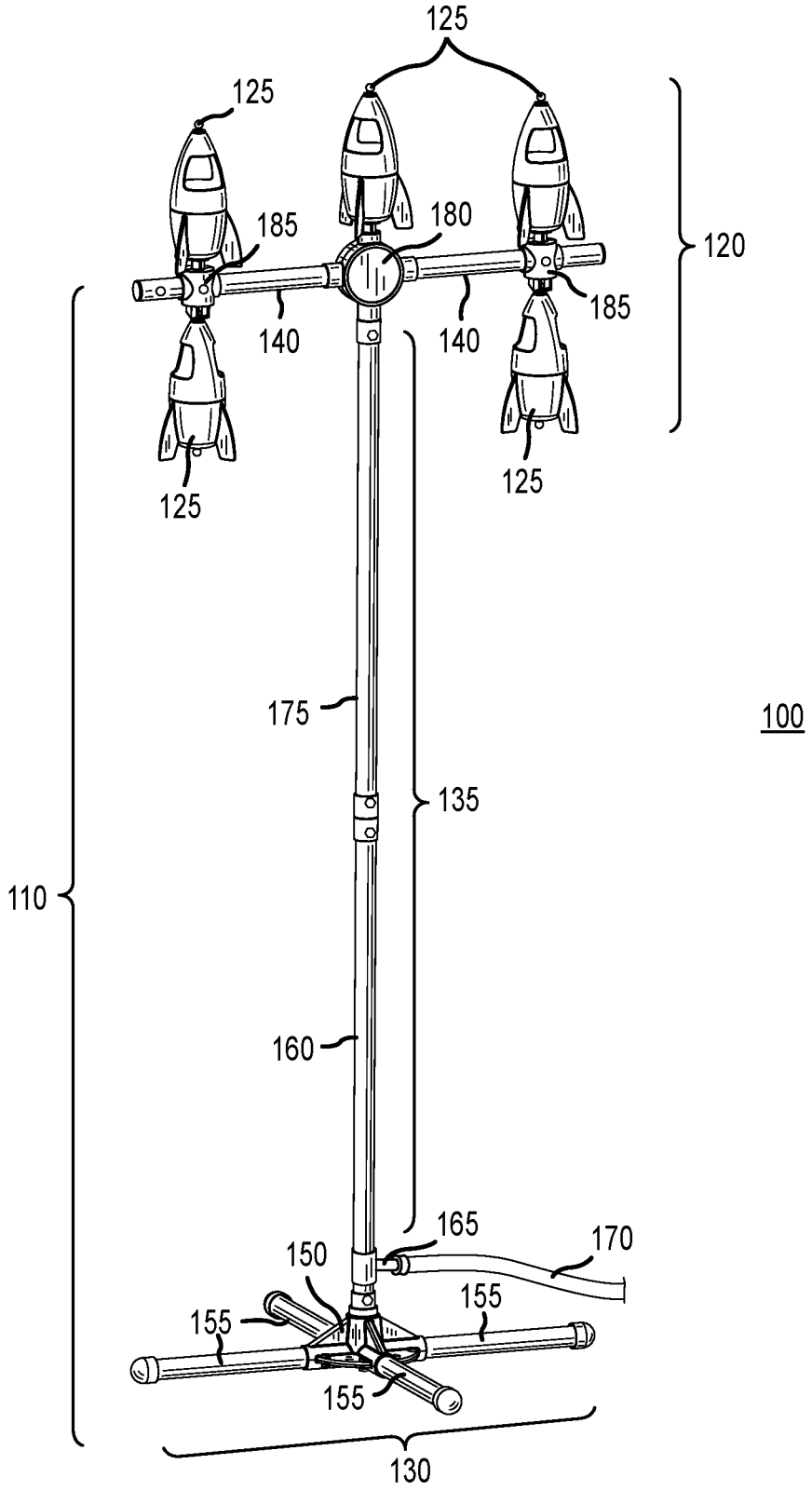
FIG. 1 is a perspective view of a water emitting game apparatus including a target framework and a plurality of water emitting targets, according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

The present invention combines a competitive objective, a degree of skill, eye-hand coordination, and camaraderie with water to provide fun, family friendly, entertainment. The flying object game of the present invention joins friendly competition among participants in a safe outdoor environment with, in one version, water to craft an enjoyable and refreshing experience. A target framework, coupled to a water source, detachably retains at least one target. One team, set a predetermined distance away from the target framework, tosses an object such as a flying disk in an attempt to dislodge and detach the target from the framework. Concurrently, the opposing team stands by near the target framework to catch any dislodged target prior to its impact with the ground or, alternatively, catch the flying object when it misses the target entirely. Points are assessed to both teams based on their performance of assigned tasks.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Included in the description are flowcharts depicting examples of the methodology which may be used play a game using a water emitting target apparatus. It will also be understood that each block of the flowchart illustrations, and combinations of blocks in the flowchart illustrations, can be implemented by special purpose hardware that perform the specified functions or steps, or combinations of special purpose hardware to achieve the same result.

FIG. 1 presents a perspective view of one inventive embodiment for a water emitting game apparatus. The apparatus 100, in this example, embodies a water emitting target(s) 125 and support structure 110. While in this example, water plays an integral part of the game, in other embodiments, water, as a component of the game, is excluded. One of reasonable skill in the relevant art will recognize that water, or similar fluid, is optional and that those embodiments described below may equally be exercised without the inclusion of water. Similarly, those embodiments described sans water may, in other versions, include water as a refreshing alternative in hot weather. Accordingly, the embodiments below are presented as way of example of an entertaining game and associated apparatus. Over versions, combinations and methodologies consistent with these descriptions, when considered in the aggregate, are contemplated and within the scope of this invention.

Turning attention again to FIG. 1, the apparatus 100 is primarily comprised of a target framework 110 and a plurality of targets 125. In the embodiment shown in FIG. 1 the framework forms a "T" structure that can rest on the ground or, alternatively, be mounted to a support structure. The targets 125 shown in FIG. 1 are, in this embodiment, are water emitting and fashioned as rockets. In other embodiments the water emitting targets may have other shapes or appearances and may or may not emit water. For example, in one version of the invention the targets may be cartoon characters, or objects representing sports teams or the like.

The target framework provides a stable platform on which to couple the targets. In this version of the invention, the target framework is comprised of several pieces of tubular pipe or conduit that are joined together to form a base 130, a vertical structure 135 and a horizonal structure 120 on which the targets 125 are detachable interlocked. In other versions the targets 125 can be coupled to the vertical structure 135 via a cord or string and in yet another embodiment the entire frame work could rotate.

The components of the base can be assembled in a variety of configurations to provide a stable platform on which to support the associated vertical and horizontal structures. In this version a center mating unit 150 joins four balance arms 155 to a lower portion 160 of the vertical structure 135. Each balance arm is connected to the center mating unit 150 and is configured to extend away from the center mating unit 150 at approximately 90-degree angles from the other balance arms 155. As a result, the combined balance arms when mated with the center mating unit form a "+" to provide uniform directional support for the targets.

In other embodiments the base can form a square, rectangle, triangle or other shapes that can provide similar stability for the target framework. And yet in other versions of the present invention the base may be omitted in favor of an inground support system in which the vertical structure couples to an existing inground permanent fixture. Similarly, the center mating unit 150 can include a removable vertical spike extending downward that can aid in its stably for insertion in to grass, soil or similar soft surfaces underneath the center mating unit. In other versions the framework could be adapted to float or reside in an aquatic environment.

The version of the base shown in FIG. 1 present a symmetric configuration but as one of reasonable skill in the appropriate art will recognize other asymmetrical configurations can also be employed and indeed contemplated.

The base of the target framework is intended to reside on the ground or similar flat surface and support the connected vertical and horizontal structures. Accordingly, the vertical structure 135 is connected to the center mating unit 150 to and extend vertically away from the ground. In one embodiment of the present invention the vertical structure and the horizontal structure are hollow tubular sections that can be configured to transport water from the lower portion of the vertical structure to the horizontal structure and ultimately to water emitting targets. The lower portion of the vertical structure 160 includes a water source connection point 165 at which a water hose 170 or similar device can be coupled to the target framework to supply water. The water source connection point enables the vertical structure and the horizontal structure to be positively pressurized with water.

In the embodiment of the present invention shown in FIG. 1, there is a lower vertical structure 160, which includes the water source connection point 165, and an upper vertical structure 170. These two vertical structure components join to form the vertical structure as shown. The overall height of the target framework can be adjusted by adding additional vertical structure components.

Coupled to the top of the upper vertical structure is a horizonal structure link 180. The link 180 is configured to connect the vertical structure 135 with two opposing horizontal (cross) structure pieces 140. On each horizontal structure component 140 is at least one target connection point 185. At each connection point 185 a target 125 can detachably interlock with the horizontal structure 120. The link 180 and each horizontal structure piece 140 are adapted, in one embodiment, to transport water from the vertical structure 135 to each target connection point 185, and ultimately to each target 125.

The version of the present invention shown in FIG. 1 presents a base 130, vertical structure 135 having two components 160, 175, a horizontal structure 120 comprised of two horizontal components 140 joined to the vertical structure 135 by a link 180. On the horizontal structure 120 are detachably interlocked five targets 125. In this version of the invention each target is the shape of a rocket and is fluidically coupled to the horizontal structure making them water emitting targets 125.

While the invention has been particularly shown and described with reference to embodiments, it will be understood by those skilled in the art that various other changes in the form, components, and details may be made without departing from the spirit and scope of the invention.

Figure 2:
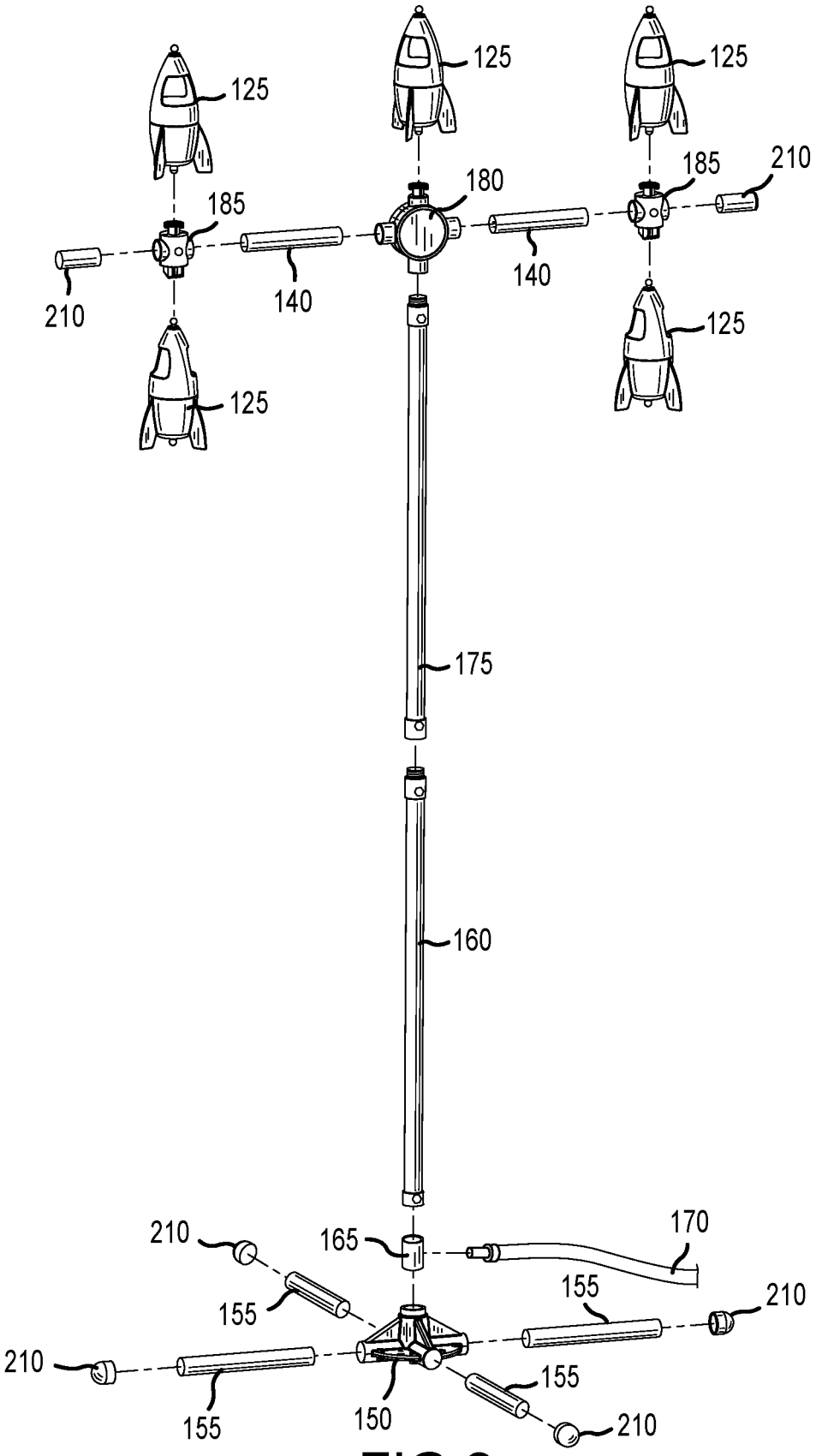
FIG. 2 is an exploded view of the water emitting game apparatus of FIG. 1, according to one embodiment of the present invention.

FIG. 2 is an explode view of the target framework and associated targets shown in FIG. 1. In this version the targets are water emitting targets. The exploded version of the target framework shows the tubular characteristic of the components as well as the caps 210 and the tees used to join the components together. While the based is, in this embodiment, composed of tubular components such as PVC pipe, in other embodiments the based may comprise rectangular or channel type structure that are equally capable of providing support. In this embodiment the vertical structure is adapted to transport water from the water source to the horizontal structure and ultimately to each water emitting target. Accordingly, the base and the center mating unit need not be tubular or capable of transporting water.

FIG. 2 further illustrates the ease as which the target framework can be assembled and disassembled. Each balance component which joins at the center mating unit to form the base can quickly be assembled and dissembled to aid in the invention's ability to be stored and transported easily. Similarly, the horizontal components can quickly be coupled to the horizontal link to complete the construction of the target framework.

The lower portion of the vertical structure includes a water source connection point 165 that includes a valve. The valve allows a user to determine whether water will comprise an element of the game when played and if so, to what degree. Each water emitting target 125 (as described in more detailed with reference to FIG. 3) are detachably interlocked with the horizontal structure. Each target is, in one embodiment, fluidically coupled to the horizontal structure at a target connection point. A valve within each connection point and with each water emitting target enables the target to be filled with water upon interlocking with the framework.

Upon being detached from the target framework the water within the water emitting target is free to disperse over any nearby participant. In another version of the present invention, the framework is not coupled to a water source and each water emitting target must be separately filled with water prior to being interlocked with the target framework. And in yet another embodiment, the target framework and the targets can be free of water entirely, for example on a cold day when getting wet may not be desirable.

Figure 3:
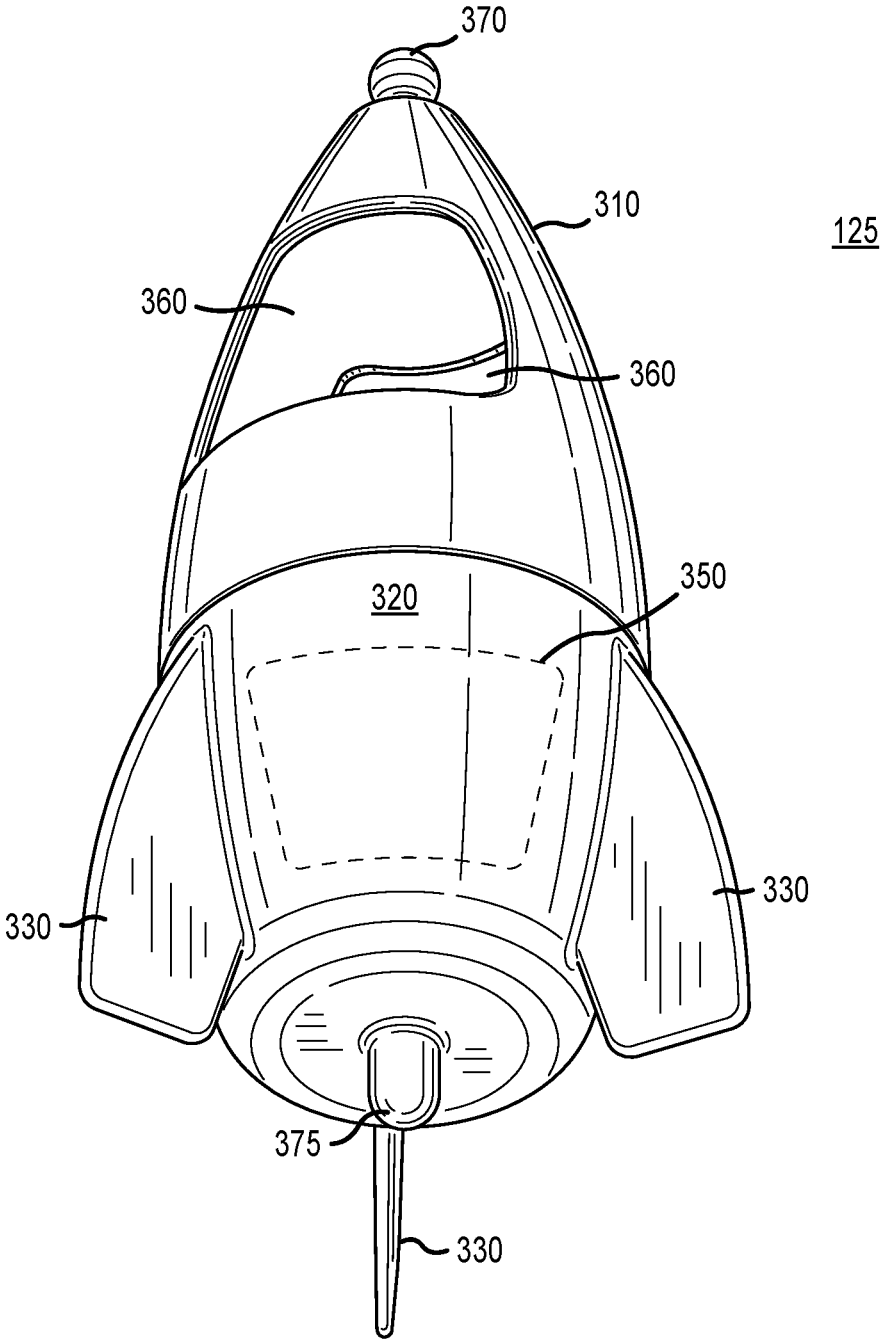
FIG. 3 is a perspective view a water emitting target apart from the target framework, according to one embodiment of the present invention.

Turning attention to FIG. 3, one can see, according to one embodiment of the present invention, a representative water emitting target 125 in the shape of a rocket. The target disclosed includes an upper rocket portion 310 and a lower rocket portion 320 with the lower rocket portion having a plurality of fins 330 for directional control when thrown. Within the rocket, and indeed within each water emitting target, is a water reservoir or water vessel 350. In one embodiment the water vessel is recharged (filled) with water upon interconnecting with the horizontal structure at a connection point. In other embodiments the water vessel is manually filled prior to use.

The upper rocket portion includes at least two windows 360 through which water can escape. The water vessel 350, which resides in the lower rocket portion, is dislodged upon the water emitting target becoming dislodged from the target framework. Once dislodged or detached from the target framework, water is free to spray on any nearby participants. In the instance in which the water emitting target is the object being tossed at the target framework, a participant catching the water emitting target in which the water vessel is full, is also likely to get wet.

In one embodiment of the present invention, the lower rocket portion 320 shown in FIG. 3 can detach from the upper rocket portion 310 to aid in refilling the water vessel. FIG. 3 also shows an upper and lower connection element for interlocking the rocket (water emitting target) with the target framework. The upper connection element 370 is a spherical shaped extrusion that joins with a complementary slot at the connection point 185. The slot is configured to press the top of the extrusion into receiving port which allows, in one embodiment, a predetermined amount of water to flow to the water vessel within the water emitting target. The slot/extrusion juncture is configured to interlock the water emitting target to the target framework until dislodged by an impact from a flying object. The slot is directed toward the participants thus upon impact the water emitting target is dislodged from the target framework toward the game participants.

The lower rocket portion 320 also includes a lower connection element 375 extrusion that joins with a connection point 185 on the horizonal structure 120 to interlock the water emitting target with the target framework. As with the upper connection element, the lower connection element fluidically couples the water emitting target to the horizontal structure to allow transfer of water from the water source to the water vessel in the water emitting target. Upon the transfer of a predetermined amount of water to the water emitting target, the valve closes readying the target for game play.

In other embodiments of the present invention the water emitting target can be interlocked (coupled) to the target framework with mechanical hooks, loops, switches, magnets, springs, cables and any other means of detachably interlocking one object to another. While one or more versions of present invention include the ability to fluidically couple the water emitting target to the target framework, other versions simply interconnect the water emitting target to the target framework with no fluidic connection. Indeed, in other versions of the present invention, water is not included or utilized in the methodology of the game. The components, targets and game in general can be played with or without water without altering the scope of the invention and operation of the game.

Recall that upon impact from a flying object a target is dislodged from the horizontal structure in a direction toward the game participants. At impact or as the target falls, water, in versions in which the target includes water, can spray on the participants who are actively trying to catch the target before it hits the ground. In another embodiment of the invention, the valve used to fill the water vessel recognizes that the water emitting target has been dislodged. As a result, a predetermined amount of water is optionally released, but as there is no longer a water emitting target interlocked (coupled) at the connection point, the water sprays out of the valve and likely impacts the nearby participants adding to the enjoyment of the game.

One embodiment of the present invention is for a kit for playing a target based outdoor game. Such a kit includes a target framework, and at least one target adapted to detachably interlock with the target framework. A water emitting target version also includes a releasable water vessel that can get participants wet as the target is dislodged. The kit further includes at least one object configured to be thrown by a person for detaching (dislodging) the target from the target framework when the object strikes the target and detaches it from the framework.

The objects thrown at the targets can take many forms. In one embodiment the object is a flying disk, while in another the object can be a bean bag. In yet another, a soft arrow or foam bullet can be thrown or shot at the target, and in yet another embodiment, additional targets themselves can be tossed at the framework in hopes to dislodge other interlocked targets. The flying disks and other flying objects of the present invention are crafted from water resistant material that is pliable and durable.

Figure 4:
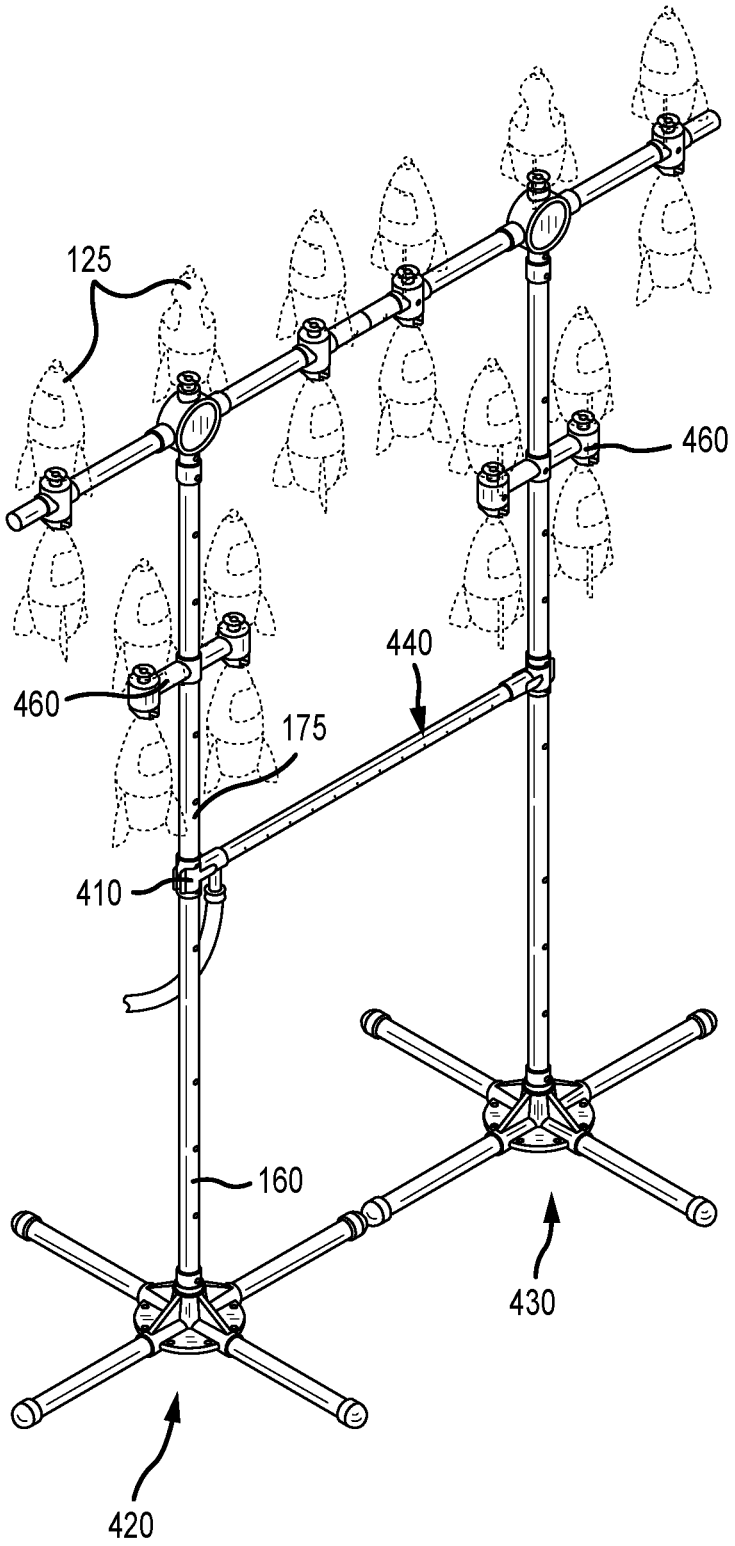
FIG. 4 is a perspective view of an expanded target framework and a plurality of water emitting targets, according to another embodiment of the present invention.

The kit of the present invention also enables the participants to expand the target framework to accommodate additional or optional water emitting targets and additional participants. The vertical structure components and the horizontal structure components are modular allowing for a simple "T" configuration of the invention be expanded. FIG. 4 is a perspective view of an expanded target framework for an outdoor game according to one embodiment of the present invention.

In the rendition shown in FIG. 4 a "T" fitting 410 is used to join the lower vertical structure 160 with the upper vertical structure 175 of the left-most target structure 420. Similarly, a "T" fitting is used to join the lower vertical structure with the upper vertical structure of the right-most target structure 430. The water source attachment point on the right-most target framework, in this embodiment of the invention, is capped while an active water source is coupled to the left-most target framework. A cross connector 440, configured to transport water from the left-most target framework to the right-most target frame is connect to each "T" fitting.

Similarly, one of the horizontal components of the left-most target structure 420 is fluidically coupled to one of the horizontal components of the right-most target structure 430. The result is an expanded target framework that, in this embodiment, can present 10 water emitting targets 125. Moreover, additional targets, water emitting or otherwise, can be added to the target frame work by adding additional connection points 460.

FIG. 4 shows two such additional connection points 460, one on the left-most target framework and one on the right-most target framework. Each additional connection point can house 4 additional targets.

The modular design of the present invention enables the user to craft numerous configurations of a target framework for an outdoor game. By obtaining additional components the target framework its versatility can be expanded to accommodate any number of participants. In one version of the present invention, the target mounts could be incorporated into ropes or similar flexible conduits that enable the targets to detachable hang from the framework. By using such a means by which to attach the targets to the framework, a glancing blow by the flying object that is insufficient to detach the target with set the target in motion, thereby making it more difficult to hit. Similarly, the structure of the framework can include hinged or rotational features that enables the structure components to freely move. For example, the entirety of the structure could be on a bearing enable the framework to rotate. Alternatively, individual components coupled to the base could be hinged to enables the structure to swing, with or without engagement by the flying object.

Supplemental components can also be added to the framework to enhance the game. Springs or pneumatics can be added to the structure and incorporated with the target mounts to enable the structure/targets to be reactive. An objective (target) can be located on the structure that triggers release of multiple targets or results in one more target to be launched/projected. Similarly, a laser or similar electronic device can be incorporated into the structure to enhance the visual effects of the game and provide real time feedback when a target is hit and detached.

Figure 5:
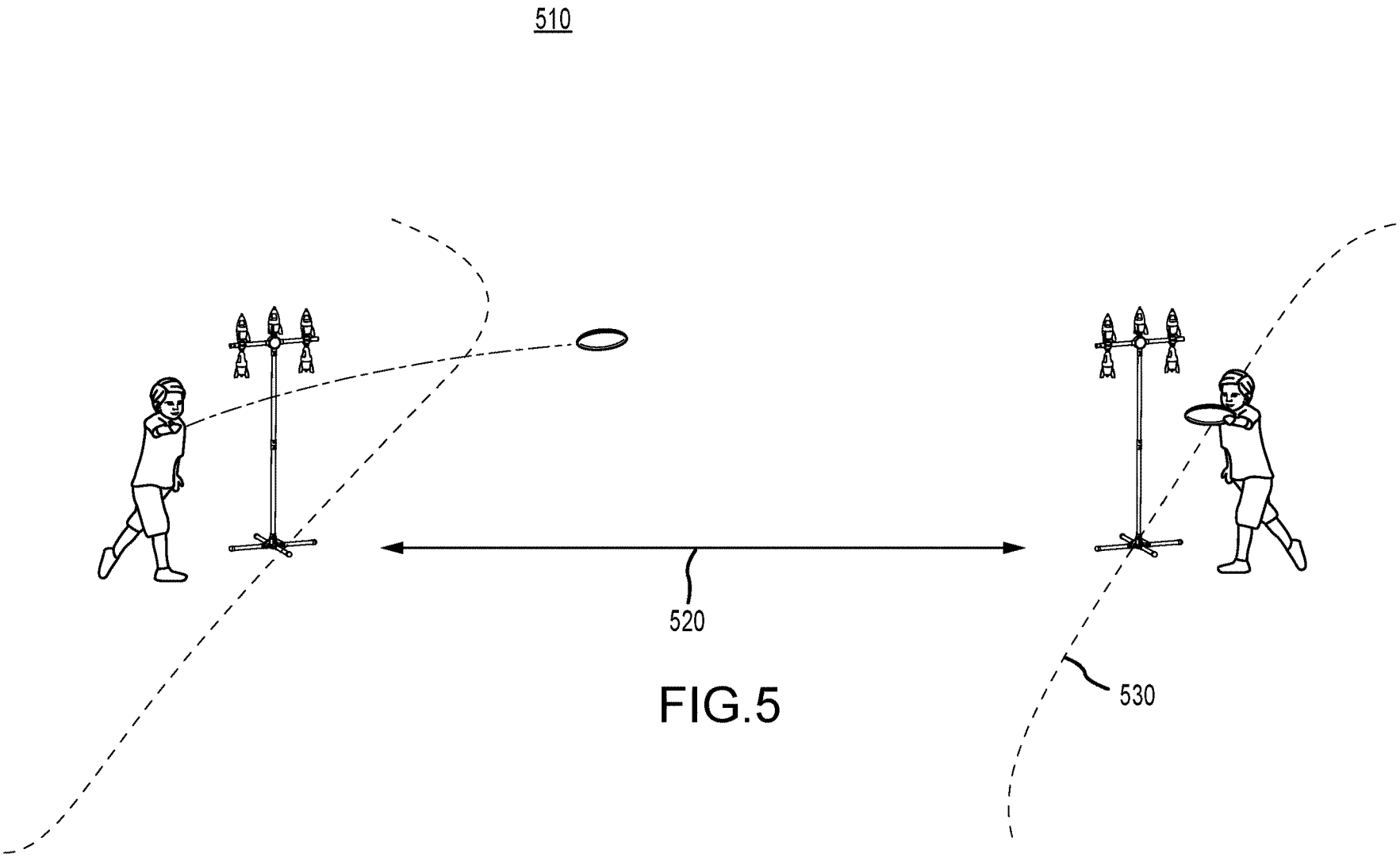
FIG. 5 is a high-level view of an environment using a water emitting game apparatus according to one embodiment of the present invention.

The outdoor game target framework, and associated targets, is a social game played by two or more opposing parties. In one embodiment, the game can be played by two individuals or by two teams, each comprised of multiple individuals. FIG. 5 depicts an environment 510 in which an outdoor game of the present invention can be played.

The game environment includes at least one target framework and two teams positioned opposite each other. One team is designated as a first, or receiving team, and the other is the second, or throwing team. FIG. 5 shows an environment having two target frameworks, but the game can be played with one target framework by simply changing the position of the receiving and throwing teams.

The first and second teams are positioned in a facing relation to each other separated by a predetermined distance 520. Set up for the game continues by placing a target framework, complete with a plurality of targets, proximate to the first team. The target framework is between the first and second teams. Said differently, the first team is positioned close to, but behind the target framework in relation to the second team.

As a flying object is tossed toward the target framework by the second team in an attempt to hit and detach a target from the target framework, the first team stands ready and nearby 530 the target framework, yet behind the target framework, to either catch any detached target before it hits the ground or catch the flying object should it miss the target framework entirely.

Each team can possess a plurality of flying objects and in other embodiments of the game, any detached flying object that is caught by the opposing team can be used to toss back toward the other team.

Figure 6:
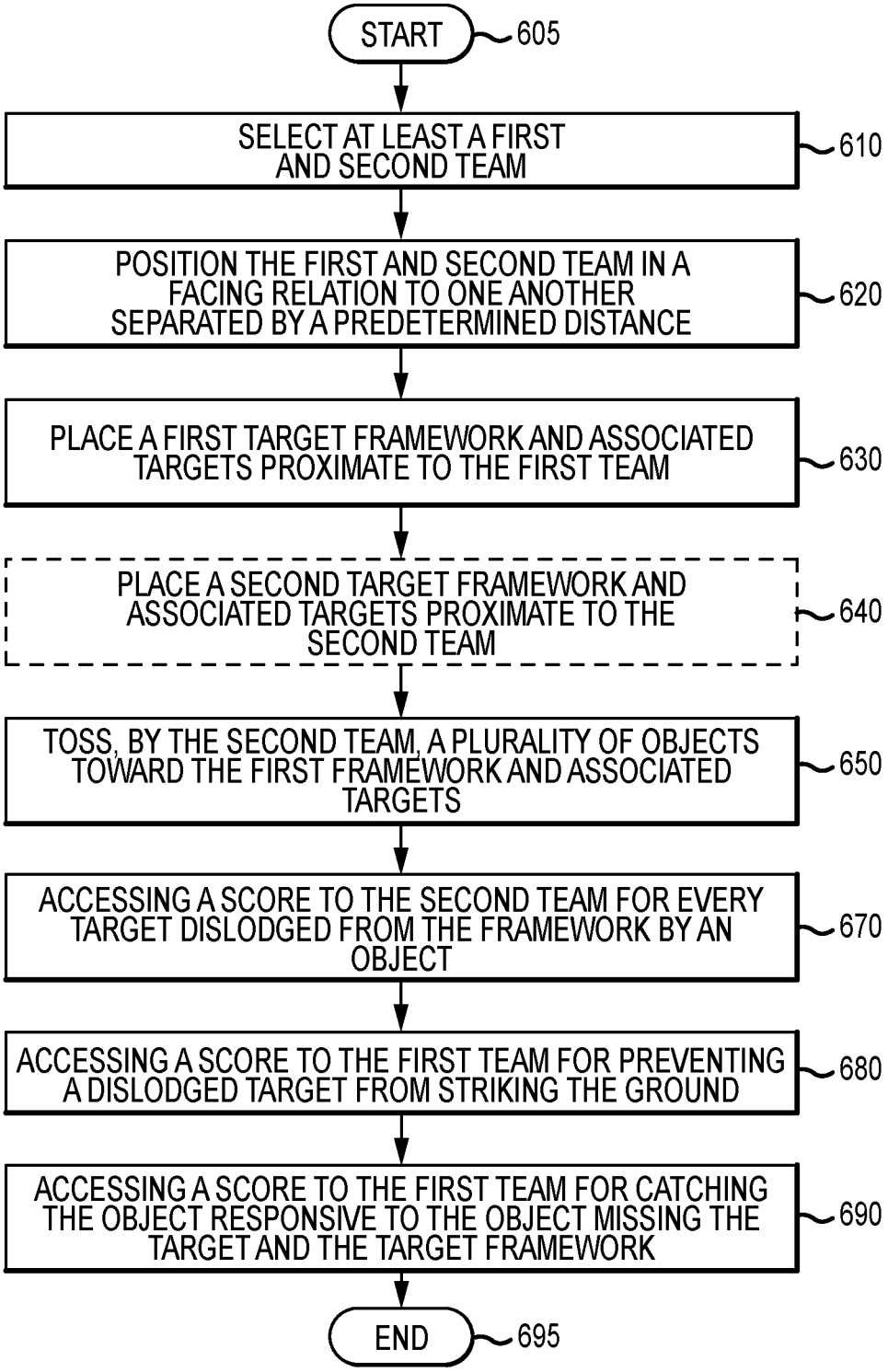
FIG. 6 is a methodology according to the present invention for playing a game having a water emitting game apparatus.

FIG. 6 is a flowchart of one method, according to the present invention, for playing a game having a game apparatus according to the present invention. As mentioned above one or two target frameworks are positioned apart from each by a predetermined distance. In other embodiments a single framework can be used. Two teams, according to one version, are selected 610 and each positioned 620 proximate 630 to, but behind, their respective target framework in a facing relation to one another.

In one embodiment of the present invention a first team is proximate to and defends its target framework 630 receiving the flying objects. The second team proximate to the second target frame work 640 tosses/throws 650 on or more objects (disks, rockets, bean bags, etc.) toward the first team's target framework with hopes to hit and detach one or more targets. Assessing points occurs based on detaching a target or catching the flying object.

Responsive to a water emitting target becoming dislodged (detached) 660 from the target framework (in version employing water emitting targets and their associated framework), water is emitted from the water emitting target and/or the target framework sufficient to impact the first team. The team striking a target, and/or the target framework, and causing one or more of the targets to become detached is assessed 670 a first score of points.

At the same time the first or receiving team stands ready to catch any detached target with the objective to prevent it from reaching the ground 680 or simply catch the flying object should it miss the target framework entirely and be assessed 690 a second score. In one embodiment of the present invention, catching a detached target is assessed more points than is gained from impacting the target framework or target itself causing it to be detached. Accordingly, the receiving team is motivated to stay close to the target framework and within a region that, upon impact, they are likely to get wet.

The game can continue until a predetermined number of points is reached or when all of the targets associated with one team's target framework are detached 695 ending the game. The game described above can have, and is contemplated to have, numerous variations consistent with the central concept of an enjoyable social outdoor game. For example, should a team catch a flying object after it misses the intended target framework, that team can not only gain points for its efforts to catch the object, but use it to toss back toward the opponents target framework.

In another embodiment of the present invention a single target framework can be used, and the two teams can rotate their relative positions. The target framework can also be used singularly for accuracy training or simply to compete between two or more individuals based on who hits more targets.

Figure 7:
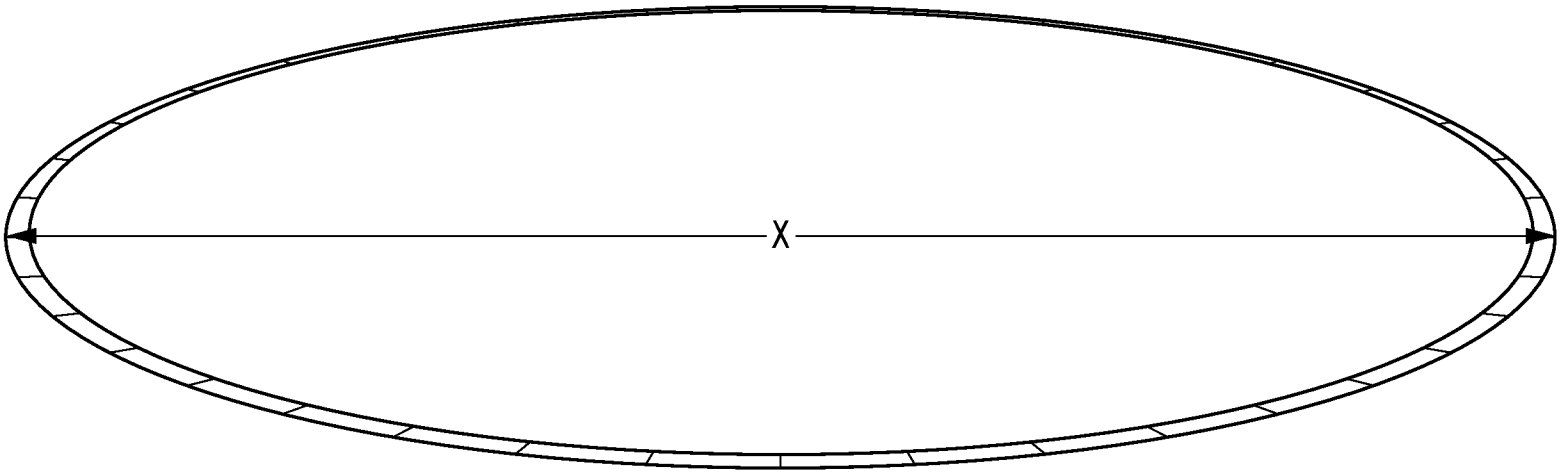
FIG. 7 shows a modular semi-rigid boundary suitable for use with one or more embodiments of the present invention to identify a field of play.

FIG. 7 a deployable and modular ring or boundary, according to one embodiment of the present invention, that can be placed around a single target framework to identify a playing region or a field of play. The ring is comprised of a plurality of modular interconnected segments that delineates an offensive and defensive environment.

According to one embodiment of the invention, a first team resides within the ring with the objective to defend a centrally located target framework. An offensive team is placed outside the boundary with the objective to maneuver freely outside of the ring and toss a flying object at the central framework to dislodge a target. The defending teams acts to block the attack. Upon achieving a predetermined set of conditions, the roles are reversed until the game ends by reaching a certain number of points. The boundary area can be sized to accommodate more or fewer players and is compatible with versions with or without water.

Figure 8:
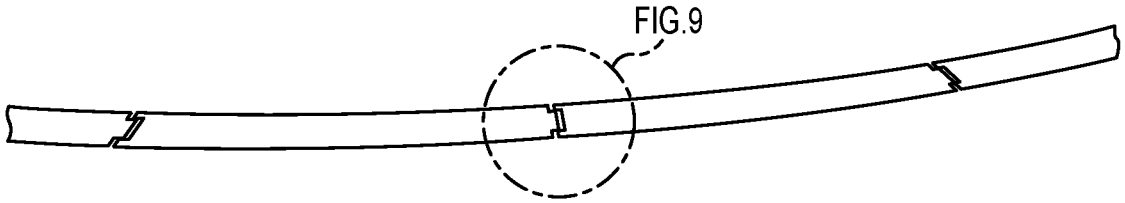
FIG. 8 shows an expanded view of the modular sections of the semi-rigid boundary, according to one embodiment of the present invention.

An expanded view of the modular components of the boundary ring is presented in FIGS. 8 and 9. The ring/boundary area, is comprised, in one embodiment, of segmented preformed material. The segments are durable and semi-rigid so that they will not be disturbed easily once established into the gaming environment, but compact and lightweight to promote transport and mobility. In one version of the present invention the segments are made of soft rubber or a similar synthetic material enabling them to be flexible but nonetheless lie flat.

Figure 9A:
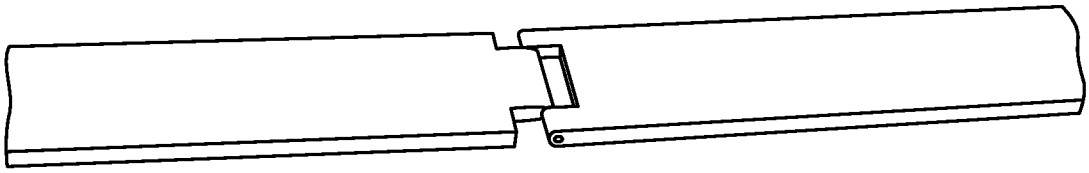
FIGS. 9A and 9B presents a detailed view of the joint mechanism for forming the semi-rigid boundary, according to one embodiment of the present invention.
Figure 9B:
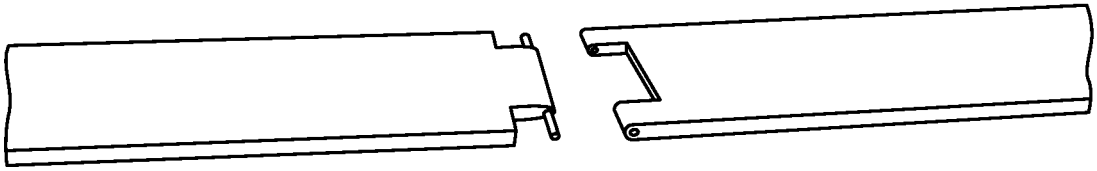

FIG. 9A and FIG. 9B present an expanded view of a coupling mechanism by which the modular sections of the transportable boundary area, according to one embodiment of the present invention. In this version each ring section includes a male and corresponding female component that is secured using a transverse pin. The pin further acts as a hinge providing the ability of the ring/boundary to articulate over uneven surfaces. And to aid in quick storage and deployment the segments can fold in a zig-zag or accordion fashion without detaching each section.

While there have been described above the principles of the present invention in conjunction with a water emitting outdoor game apparatus, kit and methodology, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

The invention claimed is:

1. A method for playing a game wherein the game is intended to be played by a first team and a second team, the method comprising:

establishing a field of play;

placing a target framework within the field of play;

positioning the first team within the field of play and proximate with the target framework;

locating the second team outside the field of play;

detachably interlocking at least one target with the target framework;

tossing a flying object by the second team towards the target framework and the at least one target;

responsive to dislodging the at least one target from the target framework by the flying object assessing a first score to the second team;

responsive to catching the dislodged target assessing a second score to the first team; and responsive to the flying object missing the target framework and catching the flying object by the first team, assessing a third score to the first team.

2. The method for playing the game according to claim 1, wherein the target framework includes a base, a vertical support structure connected to the base and a horizontal structure coupled to the vertical structure apart from the base.

3. The method for playing the game according to claim 1, wherein establishing the field of play includes positioning a plurality of modular segments to create a boundary circumscribing the target framework.

4. The method for playing the game according to claim 1, wherein interlocking includes dangling the at least one target from the target framework.

5. The method for playing the game according to claim 1 wherein the flying object is a flying disk.

6. The method for playing the game according to claim 1, further comprising responsive to striking the target framework by the flying object, launching the at least one target away from the target framework.

7. A gaming apparatus, the apparatus comprising:

a boundary establishing a field of play;

a target framework placed within the field of play;

a first team positioned within the field of play and proximate with the target framework;

a second team located outside the field of play;

at least one target configured to detachably interlock with the target framework; and a flying object configured to be tossed by the second team towards the target framework and the at least one target, wherein responsive to dislodging the at least one target from the target framework by the flying object assessing a first score to the second team, responsive to catching the dislodged target assessing a second score to the first team, and responsive to the flying object missing the target framework and catching the flying object by the first team, assessing a third score to the first team.

8. The gaming apparatus according to claim 7, wherein the target framework includes a base, a vertical support structure connected to the base and a horizontal structure coupled to the vertical structure apart from the base.

9. The gaming apparatus according to claim 7, wherein the boundary includes positioning a plurality of modular segments circumscribing the target framework.

10. The gaming apparatus according to claim 7, wherein the at least one target is configured to dangle from the target framework.

11. The gaming apparatus according to claim 7, wherein the flying object is a flying disk.

12. The gaming apparatus according to claim 7, wherein the at least one target is suspended from the at least one target framework by a flexible conduit.

13. The gaming apparatus according to claim 7, wherein the target framework is configured to couple with an additional target framework.

14. The gaming apparatus according to claim 7, wherein the flying object is a detached target.

15. The gaming apparatus according to claim 7, wherein the field of play is an area proximate to the at least one target framework within which the first team must stand.

* * * * *